US011725464B2

(12) United States Patent
Baugh

(10) Patent No.: US 11,725,464 B2
(45) Date of Patent: Aug. 15, 2023

(54) DRILLING RISER CONNECTOR

(71) Applicant: Benton Frederick Baugh, Houston, TX (US)

(72) Inventor: Benton Frederick Baugh, Houston, TX (US)

( * ) Notice: Subject to any disclaimer, the term of this patent is extended or adjusted under 35 U.S.C. 154(b) by 0 days.

(21) Appl. No.: 17/386,833

(22) Filed: Jul. 28, 2021

(65) Prior Publication Data

US 2023/0031939 A1 Feb. 2, 2023

(51) Int. Cl.

| | |
|---|---|
| ***F16L 17/03*** | (2006.01) |
| ***F16L 17/04*** | (2006.01) |
| ***F16L 17/00*** | (2006.01) |
| ***F16L 23/00*** | (2006.01) |
| ***F16L 23/08*** | (2006.01) |
| ***E21B 17/08*** | (2006.01) |

(52) U.S. Cl.

CPC ..... *E21B 17/085* (2013.01)

(58) Field of Classification Search

None

See application file for complete search history.

(56) References Cited

U.S. PATENT DOCUMENTS

| | | | | |
|---|---|---|---|---|
| 3,013,821 | A | 12/1961 | Bogan | |
| 3,157,932 | A | 11/1964 | Kyrias | |
| 4,183,189 | A | 1/1980 | Keller | |
| 4,401,164 | A | 8/1983 | Baugh | |
| 4,488,744 | A | 12/1984 | Bubeck | |
| 5,722,695 | A * | 3/1998 | Matsumoto | F16L 21/005 285/23 |
| 7,390,026 | B2 * | 6/2008 | Noda | F16L 21/065 285/365 |
| 7,665,773 | B2 * | 2/2010 | Jones | F16L 25/12 285/104 |
| 2005/0258641 | A1 * | 11/2005 | Gibb | F16L 23/18 285/112 |
| 2011/0108281 | A1 * | 5/2011 | Baugh | E21B 17/012 166/350 |

(Continued)

FOREIGN PATENT DOCUMENTS

| | | | | |
|---|---|---|---|---|
| EP | 0043593 | A1 * | 1/1982 | F16L 23/04 |

OTHER PUBLICATIONS

U.S. Appl. No. 63/057,965, filed in my name on Nov. 10, 2009 was published and is pertinent to this. I do not know the publication number. I filed a provisional application Jun. 29, 2020 as EFS ID 40134555 and U.S. Appl. No. 63/057,965 and intended to link this application to it, but could not figure out how to do it.

*Primary Examiner* — Matthew Troutman
*Assistant Examiner* — Douglas S Wood

(57) ABSTRACT

The method of providing a clamping connection comprising providing one or more clamping hubs, providing two or more clamping segments to engage the clamping hubs, constraining the clamping segments to move approximately radially with respect to the clamp hubs, providing a tension band around the clamping segments which slides circumferentially relative to the clamping segments, and adjusting the ratio of the contact area of the tension band to the clamping hubs and the area of the clamping hubs to compensate for the difference in loading on the clamping hub due to sliding friction between the tension band and the clamping hubs.

12 Claims, 7 Drawing Sheets

(56) References Cited

U.S. PATENT DOCUMENTS

| | | | | |
|---|---|---|---|---|
| 2011/0109081 | A1* | 5/2011 | Baugh | E21B 17/085<br>285/420 |
| 2015/0068759 | A1* | 3/2015 | Harbison | E21B 17/012<br>166/350 |
| 2016/0145948 | A1* | 5/2016 | Pezet | E21B 17/01<br>166/350 |
| 2021/0348703 | A1* | 11/2021 | Vorley | E21B 19/161 |

* cited by examiner

DRILLING RISER CONNECTOR

TECHNICAL FIELD

This invention relates to the general subject of connecting sections of riser pipe for drilling oil or gas wells in deep water.

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

The field of this invention is that drilling risers for deep water blowout preventer systems are major pieces of capital equipment landed on the ocean floor in order to provide a conduit for the drill pipe and drilling mud while also providing pressure protection while drilling holes deep into the earth for the production of oil and gas. The typical blowout preventer stacks have an 18¾ inch bore and are usually of 10,000 psi working pressure. The blowout preventer stack assembly weighs in the range of five hundred to eight hundred thousand pounds. It is typically divided into a lower blowout preventer stack and a lower marine riser package.

The lower blowout preventer stack includes a connector for connecting to the subsea wellhead system at the bottom on the seafloor and contains several individual ram type blowout preventer assemblies, which will close on various pipe sizes and in some cases, will close on an open hole with what are called blind rams. Characteristically there is an annular preventer at the top, which will close on any pipe size or close on the open hole.

The lower marine riser package typically includes a connector at its base for connecting to the top of the lower blowout preventer stack, it contains a single annular preventer for closing off on any piece of pipe or the open hole, a flex joint, and a connection to a riser pipe which extends to the drilling vessel at the surface.

The purpose of the separation between the lower blowout preventer stack and the lower marine riser package is that the annular blowout preventer on the lower marine riser package is the preferred and most often used pressure control assembly. When it is used and either has a failure or is worn out, it can be released and retrieved to the surface for servicing while the lower blowout preventer stack maintains pressure competency at the subsea wellhead system 36 on the ocean floor.

The riser pipe extending to the surface is typically a 21 inch O.D. pipe with a bore larger than the bore of the blowout preventer stack. It is a low pressure pipe and will control the mud flow which is coming from the well up to the rig floor, but will not contain the 10,000-15,000 psi that the blowout preventer stack will contain. Whenever high pressures must be communicated back to the surface for well control procedures, smaller pipes on the outside of the drilling riser, called the choke line and the kill line, provide this function. These will typically have the same working pressure as the blowout preventer stack and rather than have an 18¾-20 inch bore, they will have a 3-4 inch bore. There may be additional lines outside the primary pipe for delivering hydraulic fluid for control of the blowout preventer stack or boosting the flow of drilling mud back up through the drilling riser.

The time to make up individual bolting on riser connectors has always been a time consuming addition to the expensive day rates of offshore operation.

BRIEF SUMMARY OF THE INVENTION

The object of this invention is to provide a connector for the drilling riser which can be made up by the operation of a single bolt.

A second object of this invention is to provide a multi-section clamp with relatively uniform make-up around the perimeter of the connection.

A third object of this invention is to provide a connector which reduces the tendency for the portions of the clamp adjacent to the bolt to be more highly loaded than the remainder of the clamp.

Another objective of this invention is to eliminate the high stress drag on making up clamp connectors at the interfaces.

BRIEF DESCRIPTION OF THE DRAWINGS

FIG. 11 is a half section through the riser connection of FIG. 10 taken along lines "11-11".

DETAILED DESCRIPTION OF THE INVENTION

Figure 1:
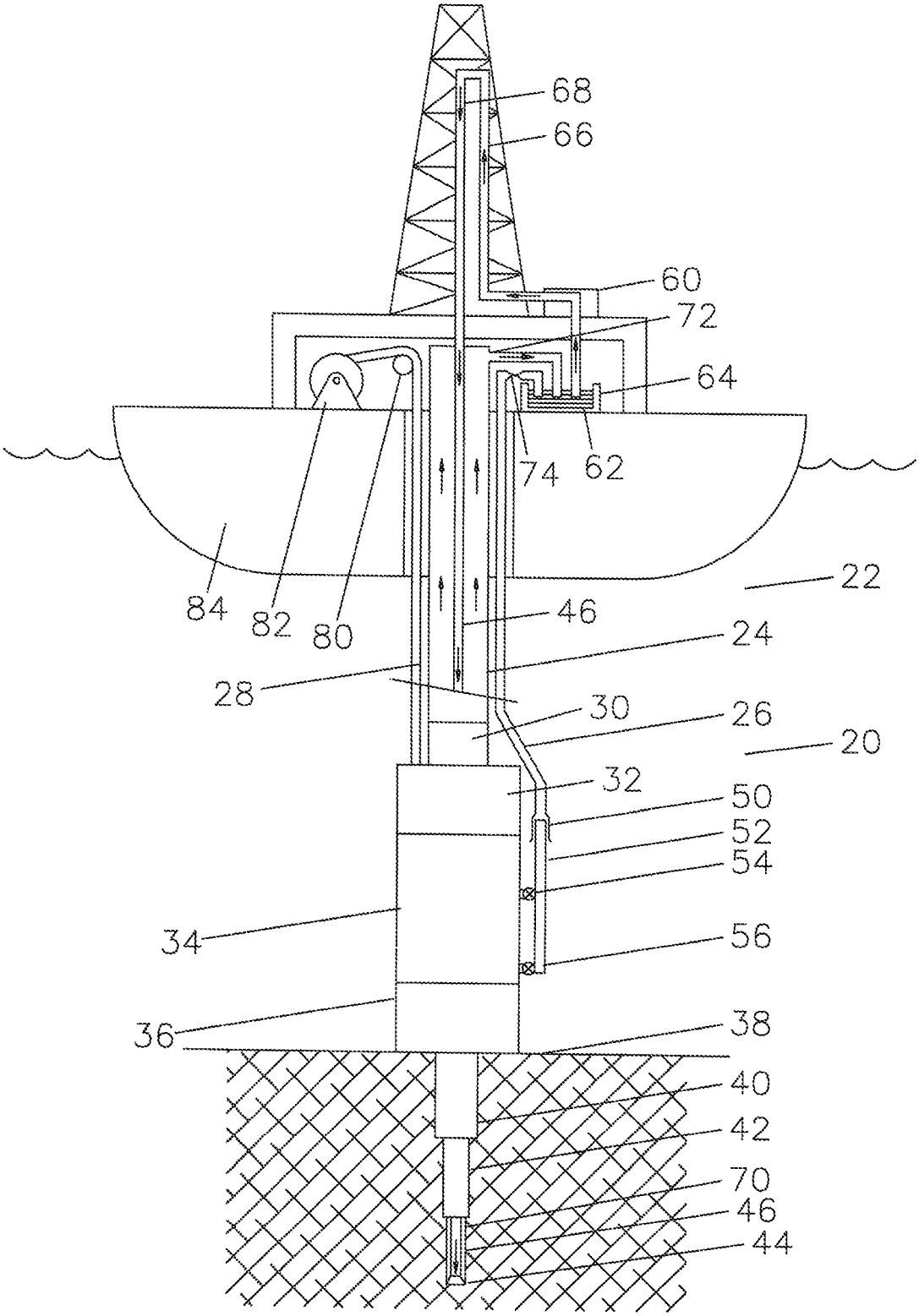
FIG. 1 is a view of a deepwater drilling system using the drilling riser connection of this invention

Referring now to FIG. 1, a view of a complete system for drilling subsea wells 20 is shown in order to illustrate the utility of the present invention. The drilling riser 22 is shown with a central pipe 24, choke or kill line 26, and control lines such as cables or hoses 28.

Below the drilling riser 22 is a flex joint 30, lower marine riser package 32, lower blowout preventer stack 34 and subsea wellhead system 36 landed on the seafloor 38.

Below the subsea wellhead system 36, it can be seen that a hole was drilled for a first casing string, that string 40 was landed and cemented in place, a hole drilled thru the first string for a second string, the second string 42 cemented in place, and a hole is being drilled for a third casing string by drill bit 44 on drill string 46.

The lower Blowout Preventer stack 34 generally comprises a lower hydraulic connector for connecting to the subsea wellhead system 36, usually 4 or 5 ram style Blowout Preventers, an annular preventer, and an upper mandrel for connection by the connector on the lower marine riser package 32.

Below outside choke or kill line 26 is a choke and kill (C&K) connector 50 and a pipe 52 which is generally illustrative of a choke or kill line. Pipe 52 goes down to choke or kill valves 54 and 56 which provide flow to or from the central bore of the blowout preventer stack as may be appropriate from time to time. Typically a kill line will enter the bore of the Blowout Preventers below the lowest ram and has the general function of pumping heavy fluid to the well to overburden the pressure in the bore or to "kill" the pressure. The general implication of this is that the heavier mud will not be circulated, but rather forced into the formations. A choke line will typically enter the well bore above the lowest ram and is generally intended to allow circulation to circulate heavier mud into the well to regain pressure control of the well.

Normal drilling circulation is the mud pumps 60 taking drilling mud 62 from tank 64. The drilling mud will be pumped up a standpipe 66 and down the upper end 68 of the drill pipe 46. It will be pumped down the drill pipe 46, out the drill bit 44, and return up the annular area 70 between the outside of the drill pipe 21 and the bore of the hole being drilled, up the bore of the casing 42, through the subsea wellhead system 36, the lower blowout preventer stack 34, the lower marine riser package 32, up the drilling riser 22, out a bell nipple 72 and back into the mud tank 64.

During situations in which an abnormally high pressure from the formation has entered the well bore, the thin walled drilling riser 22 is typically not able to withstand the pressures involved. Rather than making the wall thickness of the relatively large bore drilling riser thick enough to withstand the pressure, the flow is diverted to a choke or kill line 26. It is more economic to have a relatively thick wall in a small pipe to withstand the higher pressures than to have the proportionately thick wall in the larger riser pipe.

When higher pressures are to be contained, one of the annular or ram Blowout Preventers are closed around the drill pipe and the flow coming up the annular area around the drill pipe is diverted out through choke valve 54 into the pipe 52. The flow passes up through C&K connector 50, up choke or kill line 26 which is attached to the outer diameter of the central pipe 24, through choking means illustrated at 74, and back into the mud tanks 64.

On the opposite side of the drilling riser 22 is shown a cable or hose 28 coming across a sheave 80 from a reel 82 on the vessel 84. The cable 28 is shown characteristically entering the top of the lower marine riser package. These cables typically carry hydraulic, electrical, multiplex electrical, or fiber optic signals. Typically there are at least two of these systems, which are characteristically painted yellow and blue. As the cables or hoses 28 enter the top of the lower marine riser package 32, they typically enter the top of control pod to deliver their supply or signals. When hydraulic supply is delivered, a series of accumulators are located on the lower marine riser package 32 or the lower Blowout Preventer stack 34 to store hydraulic fluid under pressure until needed.

Figure 2:
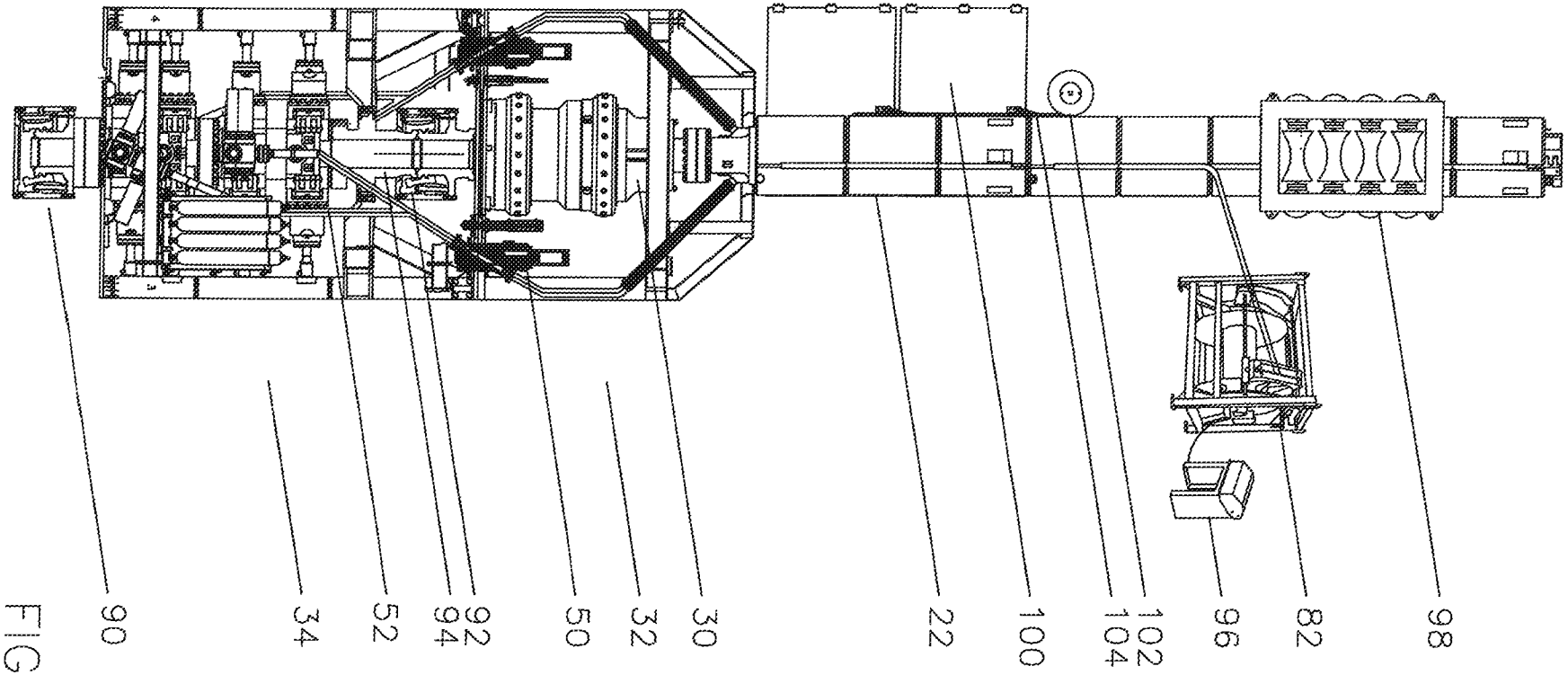
FIG. 2 is a more detailed view of the riser and blowout preventer stack as seen in FIG. 1.

Referring now to FIG. 2. a portion of the complete system for drilling subsea wells 20 is shown in greater detail for better clarity. Connector 90 at the bottom is hydraulically operated to provide a connection between the lower blowout preventer stack 34 and the subsea wellhead system 36 as shown in FIG. 1. Hydraulic connector 92 provides a connection between the lower marine riser package 32 and mandrel 94 on the lower blowout preventer stack 34.

Control panel 96 is shown to control the reel 82. Centralizer 98 would be used to control the position of the riser as it is being pulled in currents to prevent it from be pushed into the side of the rotary table by the currents. Fairings 100 can be used to provide a better flow profile and reduce the drag forces on the riser. Winch 102 and chain 104 indicate that the fairings are of a "run through" type which means they are independently supported from the drilling rig, can be run after the riser is in the water, and can remain in place when most of the riser is retrieved, rather than the style which are fixed to individual riser joints.

Figure 3:
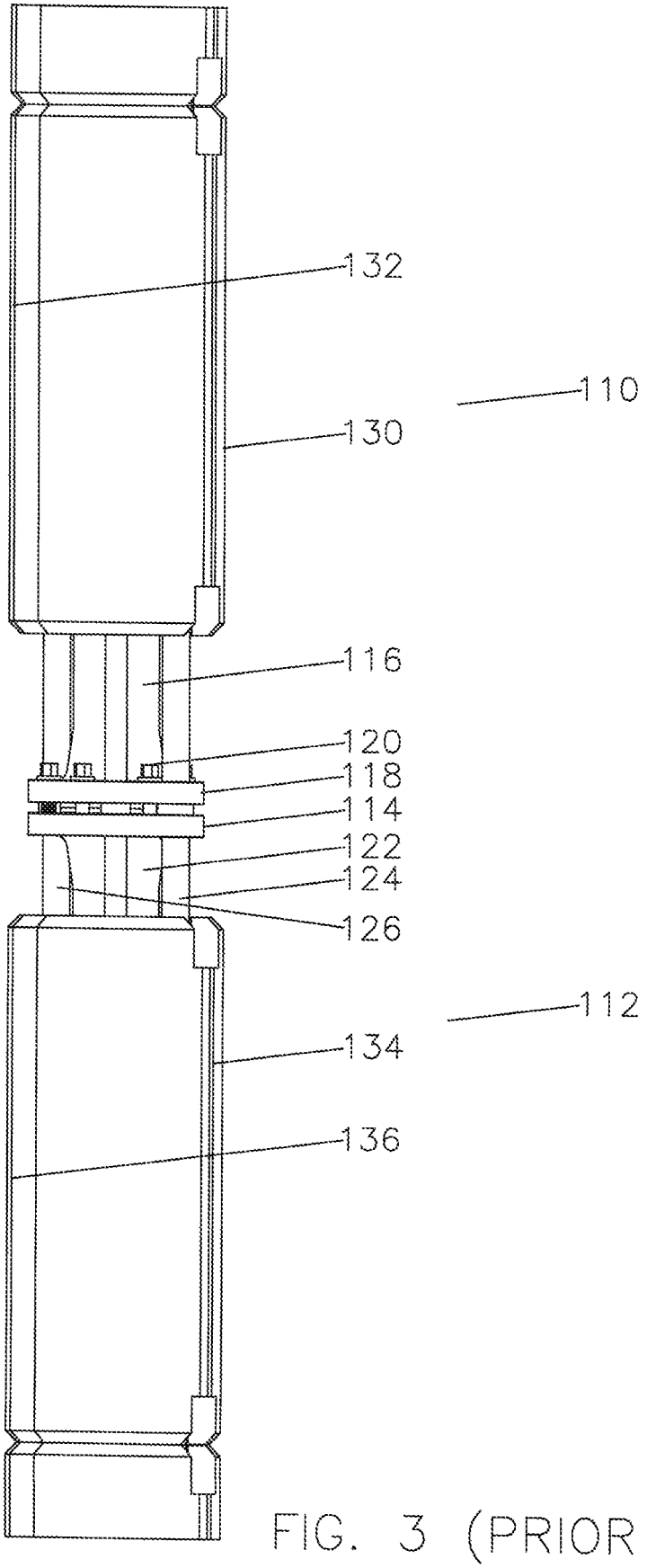
FIG. 3 (PRIOR ART)
FIG. 3 is a view of a portion of a conventional drilling riser using a conventional connection.

Referring now to FIG. 3, the connection of two sections of conventional drilling riser 110 is seen. On the upper end of a conventional riser joint 112 an upper flange 114 is seen. It is connected to the flange on the lower end of the adjacent conventional riser joint 116 by lower flange 118 and a multiplicity of bolts 120. The pipe 122 between the upper flange 114 and the lower flange 118 on the same riser joint is typically of a 21" outer diameter, with a varying wall thickness depending primarily on water depth and the resulting tensile loadings. All risers typically will have a choke line 124 and a kill line 126 as outside fluid lines, and may also have hydraulic supply lines and mud flow boost lines. Each of these lines are the typical 70 ft. in length as is the effective length of the conventional drilling riser.

Buoyancy module sections 130 and 132 are shown attached to the lower end of the conventional riser joint 116 and buoyancy module sections 134 and 136 are shown attached to the upper end of conventional riser joint 112. The conventional riser joints are 70 ft. long and the flotation modules are conventionally 129" long. Six sections of the 129" long flotation are attached to each riser joint, leaving a gap of 60" or 5 feet in the area of the connection. The space on the upper end of conventional riser joint 112 is used for the insertion of support dogs when running the riser. The larger space on the bottom of the adjacent riser joint 116 is used for the insertion of a hydraulic make-up wrench when running the riser. It is conventional to use 6 support dogs, giving 6 spaces for bolts between the outside fluid lines.

Figure 4:
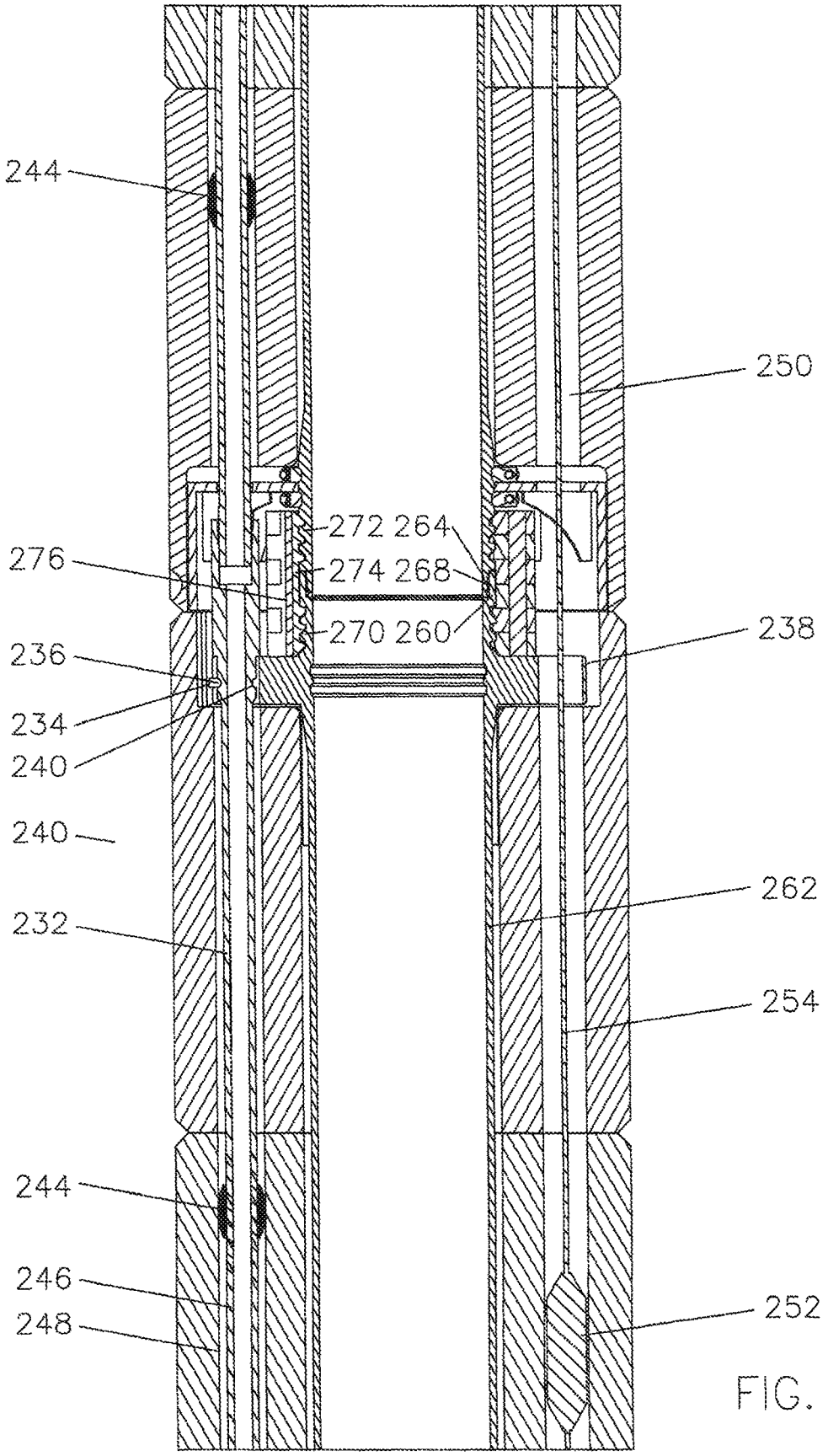
FIG. 4 shows a half section is shown through a riser joint using a connector of this invention.

Referring now to FIG. 4, a half section is shown through a riser joint using a connector of this invention. Passageway 230 has outside fluid line 232 installed with a retaining pin 234 installed into a hole 236 in the side of flange 238 to engage groove 240 to fix the outside fluid line 232 in place. Stabilizing centralizers 244 are shown to stabilize fluid line 232 within passageway 246.

Passageway 250 has not received an outside fluid line, but rather is shown as providing a passageway for other services. These services can be to lower instrumentation 252 on a wire 254 such as is shown to measure vortex induced vibration in a riser. Alternately passageway 250 can provide a passageway all the way to the bottom like the vacuum tubes used in banks. A hose can be lowered down to deliver hydraulic fluid. A control connector can be lowered on a control line to provide backup control for a blowout preventer stack in case of controls difficulties. A "Go-Devil" on simple weight can be dropped to actuate a single function in an emergency situation. Basically passageway 250 becomes a utility passageway for anything which needs to be done along or at the bottom of the riser.

A receptacle 260 at the upper end of lower riser pipe 262 is engaged by nose 264 on the lower end of upper riser pipe 266. Seals 268 seal between receptacle 260 and nose 264. The upper end of lower riser pipe 262 has a clamping profile 270 and the lower end of upper riser pipe 266 has a clamping profile 272. Clamp segments 274 engage the clamping profiles 270 and 272. Tension band 276 urges clamp segments 274 into engagement with clamping profiles 270 and 272 to secure the connection.

Figure 5:
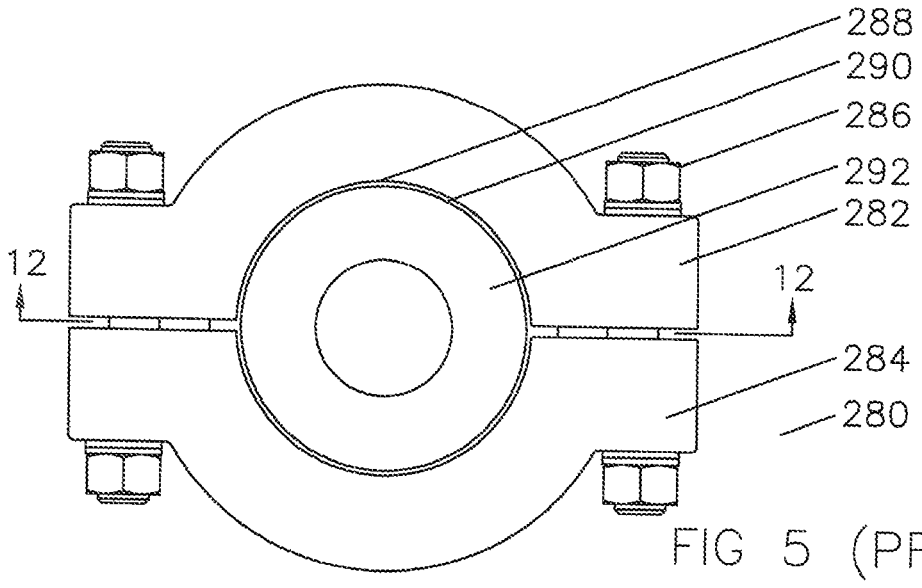
FIG 5 (PRIOR ART)
FIG. 5 is a view of a prior art clamp made up.

Referring now to the prior art of FIG. 5, the advantage for the novel design of this invention becomes apparent to those of skill in the art. A two section clamp 280 has clamp halves 282 and 284 tightened on clamp hubs 280 by bolts 286. The inner diameter 288 is intended to be pulled to be concentric with diameter 290 of the clamp hubs 292.

Figure 6:
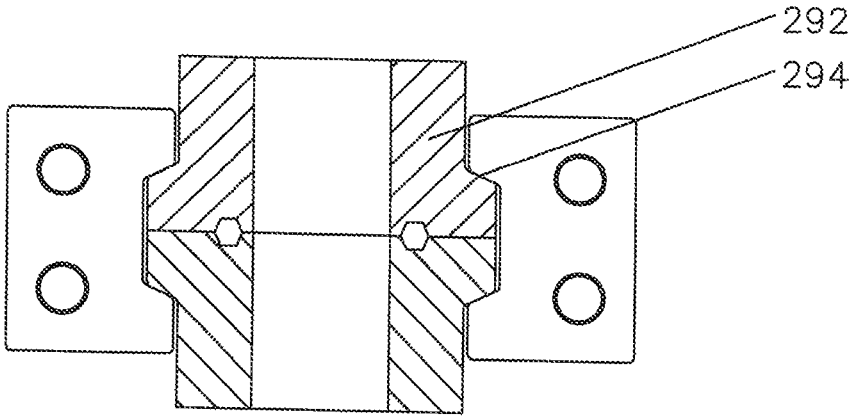
FIG 6 (PRIOR ART)
FIG. 6 shows a half section of a clamp taken along lines "6-6" of FIG. 5.

Referring now to FIG. 6, a half section of a clamp taken along lines "6-6" of FIG. 5 shows the engagement of the clamp halves is shown to be on a taper 294 which has approximately a 25-degree slope. It is literally a wedge moving onto the clamp hubs.

Figure 7:
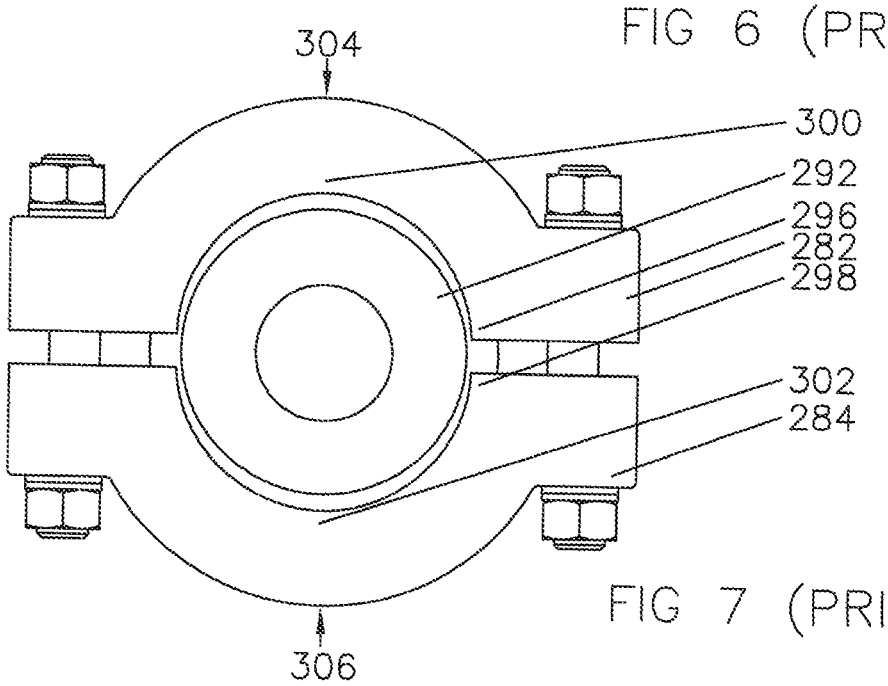
FIG 7 (PRIOR ART)
FIG. 7 shows a view similar to FIG. 5 is shown, but with the clamps about ¼" from full make-up.

Referring now to FIG. 7, a view similar to FIG. 5 is shown, but with the clamps about ¼" from full make-up. Clamp sections 282 and 284 are actually touching clamp hubs 292 only at areas 296 and 298 respectively. Literally no contact is made at areas 300 and 302. The situation is that of a wedge being drug sideways onto the clamp hubs. The result of this type make-up is that the loading in the general areas of 296 and 398 will be high and the loading at 300 and 302 will be low. In some cases the clamp sections of this type are struck with a sledge hammer at locations 304 and 306 to jar the clamp sections into a position of more uniform loading around the circumference. The irregularity of this make-up can be tolerated on small clamps and clamps which have relatively low loading. On high load clamps such as on deepwater drilling risers, this irregularity of make-up is simply not acceptable.

Figure 8:
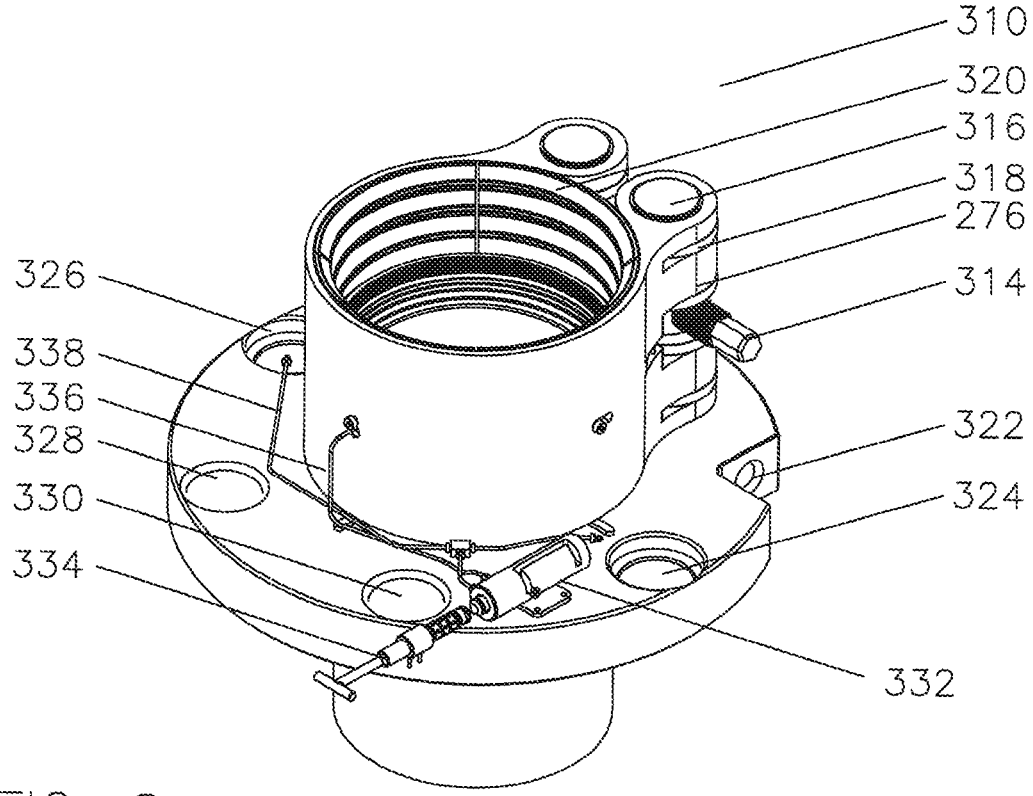
FIG. 8 shows a perspective view of a female half of a riser connector.

Referring now to FIG. 8, a perspective view of a female half of a riser connector 310 is shown with tension band 276, actuating screw 314 engaging axle 316, wheel 318, clamp segment 320, torque reaction hole 322, choke fitting hole 324, kill fitting hole 326, vertical access holes 328 and 330, test receptacle 332, test fitting 334, low pressure test connections 336 and high-pressure test connections 338 (to a choke or kill fitting which is not shown).

Figure 9:
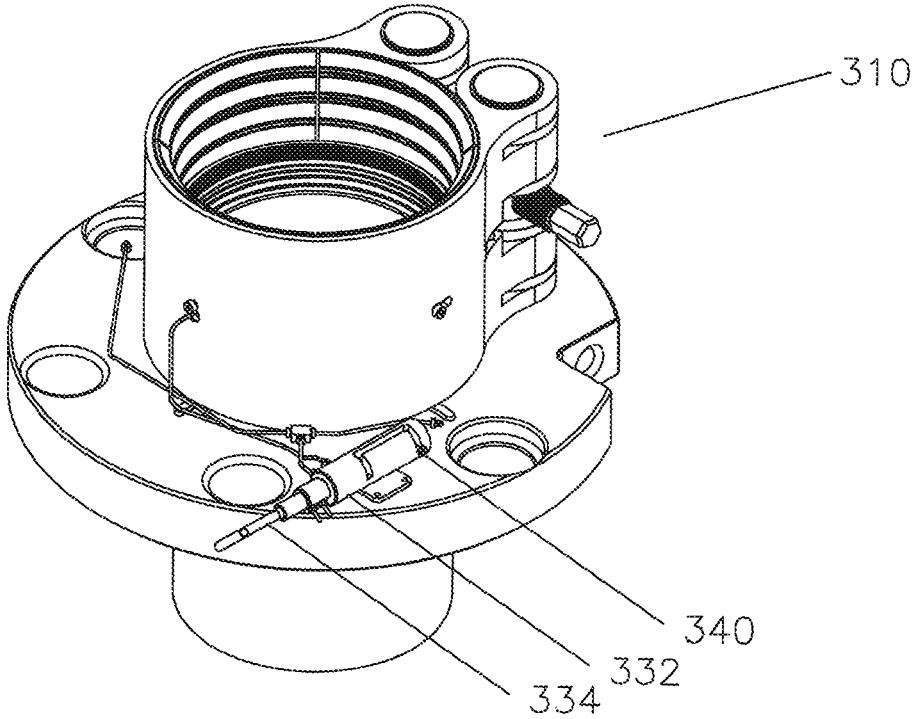
FIG. 9 shows a perspective view of a female half of a riser connector with a test plug inserted.

Referring now to FIG. 9, a perspective view of riser connector 310 similar to FIG. 8 is shown except test fitting 334 is now installed in test receptacle 332. It will be noted that the handle 340 portion of the test receptacle 342 is moved to a rear position.

Figure 10:
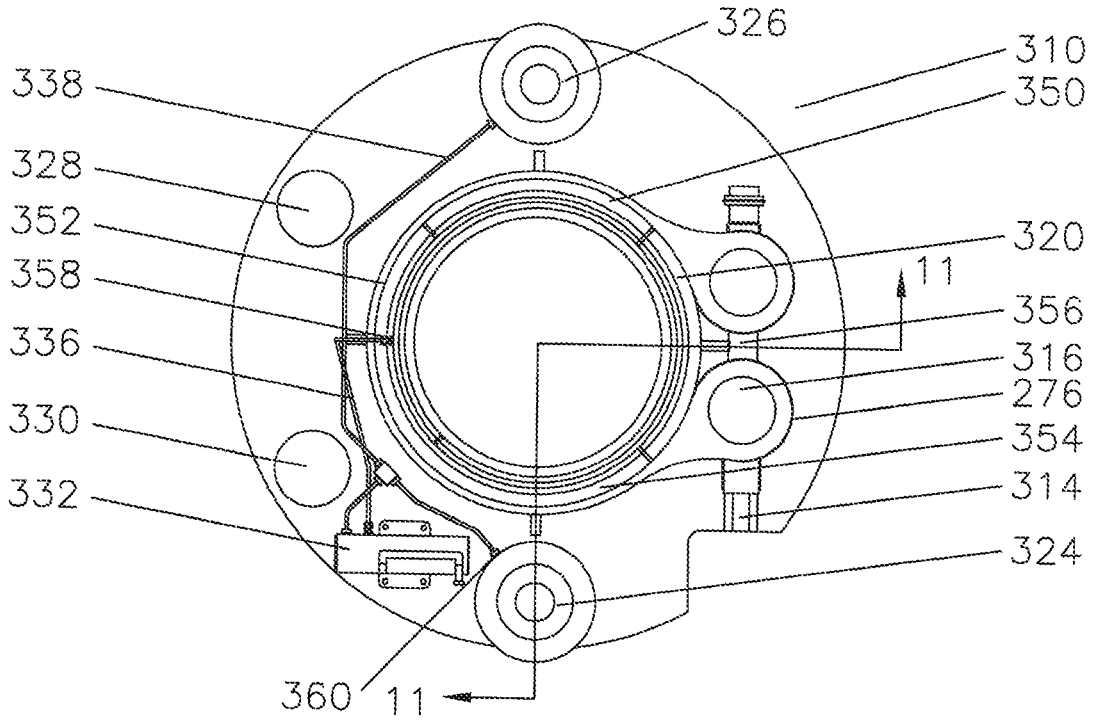
FIG. 10 shows a top view of FIG. 9 without the test plug.

Referring now to FIG. 10 which is a top view of FIG. 9 without the test plug, clamp segments 350, 352, and 354 are shown as well as clamp segment 320, and showing that clamp segment 320 bridges the gap 356 between the ends of the tension band 276 and shows low pressure test connection 358 and high-pressure test connection 360.

Figure 11:
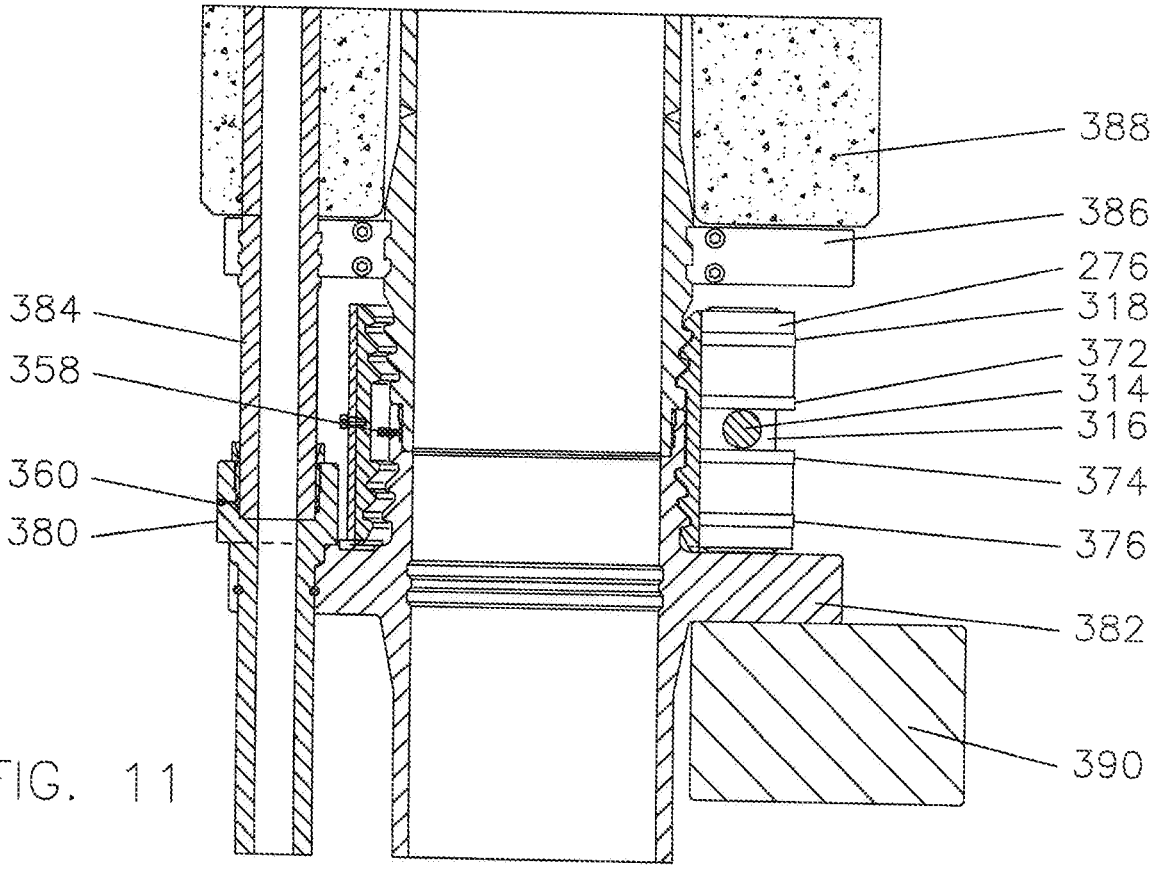
FIG. 11 is an end view of a conventional clamp.

Referring now to FIG. 11 is a view of FIG. 10 taken along lines "11-11" showing that in addition to the clamp segments being arranged to bridge the gap in the tension band 276, wheels 318, 372, 374 and 376 are added to axle 316 to further minimize the high frictional forces associated with the end of tension bands like 276. Low pressure test connection is shown on the central riser as the test pressure will be in the range of 1000-3000 p.s.i. and high-pressure test connection 360 is shown on choke or kill connection 380 as the test pressure will be 20,000 p.s.i., which would crush the central riser pipe. The choke or kill connection 380 is retained in flange 382 whereas the other end of each section of choke or kill pipe 384 is retained by flange 386. Flotation 388 for riser joints and rig floor riser support dogs 390 are shown.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

Sequence Listing: N/A

That which is claimed is:

1. A method of providing a clamping connection comprising providing two or more clamping hubs, providing two or more clamping segments to engage the two or more clamping hubs, constraining the two or more clamping segments to move approximately radially with respect to the two or more clamping hubs, providing a tension band around the two or more clamping segments, providing a gap between ends of the tension band, providing an axle on each end of the tension band, providing one or more bolts through the axels to tighten the tension band, providing the one or more of the two or more clamping segments bridges across the gap between the ends of the tension band and further comprising providing one or more wheels on the axles which engage at least one of the two or more clamping segments and partially separate a portion of the one or more tension bands from the two or more clamping segments to reduce the sliding friction.

2. The method of claim 1 further comprising the clamping connection is on a subsea drilling riser.

3. The method of claim 1 further comprising providing a torque reaction hole.

4. The method of claim 1 further comprising providing choke and kill fitting holes.

5. A method of providing a clamping connection comprising providing two or more clamping hubs, providing two or more clamping segments to engage the two or more clamping hubs, providing a tension band around the two or more clamping segments, providing a gap between ends of the tension band, providing an axle on each end of the tension band, providing one or more bolts through the axles to tighten the tension band, providing the one or more of the two or more clamping segments bridges across the gap between the ends of the tension band, and further comprising providing one or more wheels on the axles which engage at least one of the two or more clamping segments and partially separate a portion of the one or more tension bands from the two or more clamping segments to reduce the sliding friction.

6. The method of claim 5 further comprising the clamping connection is on a subsea drilling riser.

7. The method of claim 5 further comprising providing a torque reaction hole.

8. The method of claim 5 further comprising providing choke and kill fitting holes.

9. A method of providing a clamping connection comprising providing two or more clamping hubs, providing two or more clamping segments to engage the two or more clamping hubs, providing a tension band around the two or more clamping segments, providing a gap between ends of the tension band, providing an axle on each end of the tension band, providing the one or more of the two or more clamping segments bridges across the gap between the ends of the tension band, and further comprising providing one or more wheels on the axles which engage at least one of the two or more clamping segments and partially separate a portion of the one or more tension bands from the two or more clamping segments to reduce the sliding friction.

10. The method of claim 9 further comprising the clamping connection is on a subsea drilling riser.

11. The method of claim 9 further comprising providing a torque reaction hole.

12. The method of claim 9 further comprising providing choke and kill fitting holes.

* * * * *